US010287763B2

(12) United States Patent
Wang et al.

(10) Patent No.: US 10,287,763 B2
(45) Date of Patent: May 14, 2019

(54) TOILET PLUNGER

(71) Applicants: Tianzhe Wang, Shaker Heights, OH (US); Jason Sharratt, Seville, OH (US); Andrew Byron Logar, Willowick, OH (US); Martin Dusan Marsic, Highland Heights, OH (US)

(72) Inventors: Tianzhe Wang, Shaker Heights, OH (US); Jason Sharratt, Seville, OH (US); Andrew Byron Logar, Willowick, OH (US); Martin Dusan Marsic, Highland Heights, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 0 days.

(21) Appl. No.: 15/689,398

(22) Filed: Aug. 29, 2017

(65) Prior Publication Data

US 2018/0163383 A1 Jun. 14, 2018

Related U.S. Application Data

(60) Provisional application No. 62/433,927, filed on Dec. 14, 2016.

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.01–255.19
See application file for complete search history.

(56) References Cited

U.S. PATENT DOCUMENTS

| | | | | |
|---|---|---|---|---|
| 6,192,525 | B1 * | 2/2001 | Tash | E03C 1/308 4/255.11 |
| 2003/0079278 | A1 * | 5/2003 | Tash | E03C 1/30 4/255.11 |
| 2013/0125298 | A1 | 5/2013 | Guthrie | |
| 2014/0115768 | A1 * | 5/2014 | Wang | E03D 9/00 4/255.11 |

* cited by examiner

*Primary Examiner* — Christine J Skubinna
(74) *Attorney, Agent, or Firm* — Fay Sharpe LLP

(57) ABSTRACT

A plunger having a plunger body with a handle flange portion for connection to an associated handle, a domed portion extending from the handle flange portion, a frustoconical portion extending from the domed portion, and a first bulbous portion extending from the frustoconical portion, wherein the domed portion is configured to collapse at least partially into the frustoconical portion during use.

13 Claims, 9 Drawing Sheets

TOILET PLUNGER

CROSS REFERENCE TO RELATED PATENTS AND APPLICATIONS

This application claims priority to and the benefit of the filing date of U.S. Provisional Patent Application Ser. No. 62/433,927, filed Dec. 14, 2016, which application is hereby incorporated by reference.

BACKGROUND

The present exemplary embodiments relate to devices for clearing clogged drains. They find particular application in conjunction with toilet plungers, and will be described with particular reference thereto. However, it is to be appreciated that the present exemplary embodiment is also amenable to other like applications.

A well-known method for clearing a clogged toilet drain includes using a toilet plunger to apply pressure and/or suction to the drain line to clear the obstruction. Toilet plungers have existed in one form or another for virtually as long as the conventional toilet. A typical plunger includes a deformable plunger head secured to the end of a handle. The deformable head is placed in the toilet bowl over the toilet drain opening and the handle is moved up and down to cause a flexing of the deformable plunger head. On the downward stroke, the plunger head displaces water to apply a pressure to the drain line. On the contrary, as the handle is moved upward, a suction may be applied to the drain line. When properly performed, the alternating pressure/suction is, in most cases, sufficient to clear the drain line.

Modern toilets implement special features to conserve water. Such low-flow toilets may use as little as a gallon of water per flush. To achieve adequate functionality with such low flow, these toilets have specially-designed drain openings with more narrow passageways and many also employ a siphon jet for aiding in evacuation of the toilet bowl. A siphon jet is an opening towards the front of the bowl the directs water from the toilet tank directly into the toilet drain opening to aid with transporting waste into the toilet drain line.

Due to these changes in toilet design, many modern toilets are more difficult to clear with a conventional plunger. Conventional plungers can be too wide to fit properly into the narrow throat of the newer toilet. As such, an inadequate seal is often achieved. In addition, even if a sufficient seal is achieved around the throat, the existences of the siphon jet within the throat can provide a path of leakage during the plunging operation such that full pressure/suction cannot be applied to the clog within the drain line. Thus, conventional plungers are often not generally well-suited to provide sufficient pressure or suction for the purpose of dislodging obstructions in newer toilets.

BRIEF DESCRIPTION

The present disclosure sets forth a toilet plunger that overcomes one or more of the aforementioned deficiencies.

In accordance with one aspect, a plunger comprises a plunger body having a handle flange portion for connection to an associated handle, a domed portion extending from the handle flange portion, a frustoconical portion extending from the domed portion, and a first bulbous portion extending from the frustoconical portion, wherein the frustoconical portion has a wall thickness that is greater than a wall thickness of the first bulbous portion.

The domed portion can include a wall having a reduced cross-section thickness portion adjacent the frustoconical portion, wherein the domed portion is configured to collapse about the reduced cross-section thickness portion into at least a portion of the frustoconical portion. The plunger can further include a second bulbous portion extending from the first bulbous portion. The first and second bulbous portions can each have a wall thickness less than the domed portion and the frustoconical portion. The body can be a unitary, molded one-piece body. The domed portion can have at least one rib on an inner surface thereof, the at least one rib configured to maintain a minimum amount of space between the domed portion and the frustoconical portion when the domed portion is collapsed into the frustoconical portion.

In accordance with another aspect, a plunger comprises a body with an interior chamber and an opening in the body for accessing the interior chamber, the opening in the body extending in a plane perpendicular to a central axis of the body, the body having a first wall section extending circumferentially about the central axis, and a second wall section extending circumferentially about the central axis from the first wall section, the first wall section being relatively less rigid in compression along the central axis than the second wall section such that the first wall section collapses into the second wall section under compression.

The first wall section can be thicker than the second wall section. The second wall section can be frustoconical and taper in diameter in a direction away from the first wall section. The plunger can further comprise a third wall section extending circumferentially about the central axis from the second wall section, the third wall section being relatively less rigid in compression along the central axis than the second wall section. The first wall section can be a domed portion of the plunger and the second wall section can be a frustoconical portion of the plunger. The domed portion can have at least one rib on an inner surface thereof within the internal chamber, the at least one rib configured to maintain a minimum amount of space between the domed portion and the frustoconical portion when the domed portion is collapsed into the frustoconical portion.

DETAILED DESCRIPTION

Figure 1:
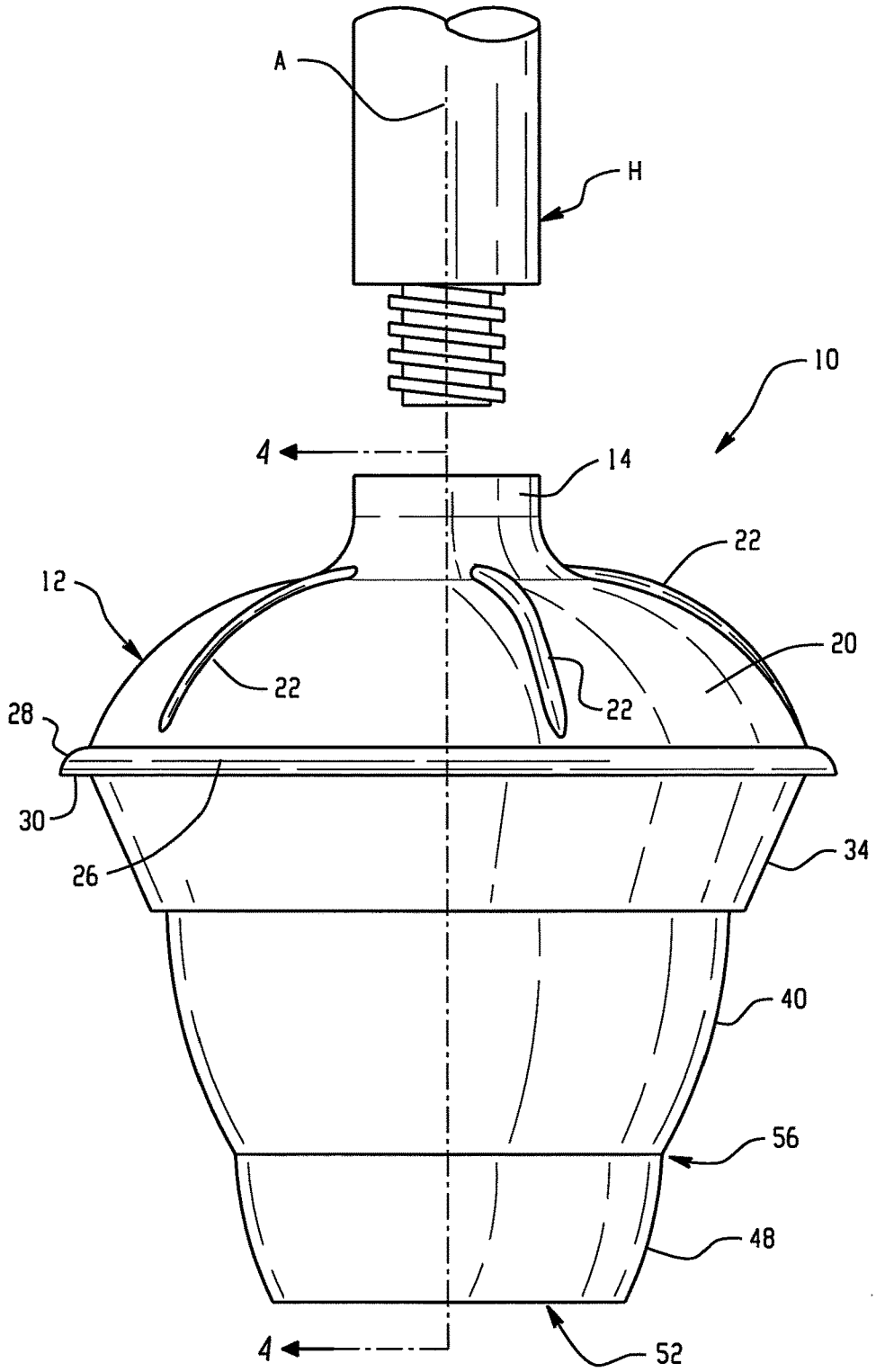
FIG. 1 is a side view of an exemplary plunger in accordance with the present disclosure.

With reference to FIGS. 1-5, an exemplary plunger head in accordance with the present disclosure is illustrated and identified generally by reference numeral 10. The plunger head 10 is a unitary, one-piece body 12 that can be described as having a plurality of discrete portions. The body 12 can be made of an elastomeric material such as rubber, and formed in a molding process, for example.

With continued reference to FIGS. 1-5, each of the following portions of the body 12 will be described: handle flange portion 14, domed portion 20, perimeter flange 26, frustoconical portion 34, first bulbous portion 40, and second bulbous portion 48. It should be appreciated that each of the components of the plunger mentioned in the previous sentence are arranged axially about a central axis A of the plunger 10. In the illustrated embodiment of FIGS. 1-5, the frustoconical portion 34 has an axial length that is less than each of the domed portion 20 and the first bulbous portion 40. The second bulbous portion 48 has an axial length less than the first bulbous portion. In some exemplary embodiments, the plunger body is comprised of a unitary, one-piece molded elastomeric material having a durometer range from Shore A 40 to Shore A 90.

Figure 2:
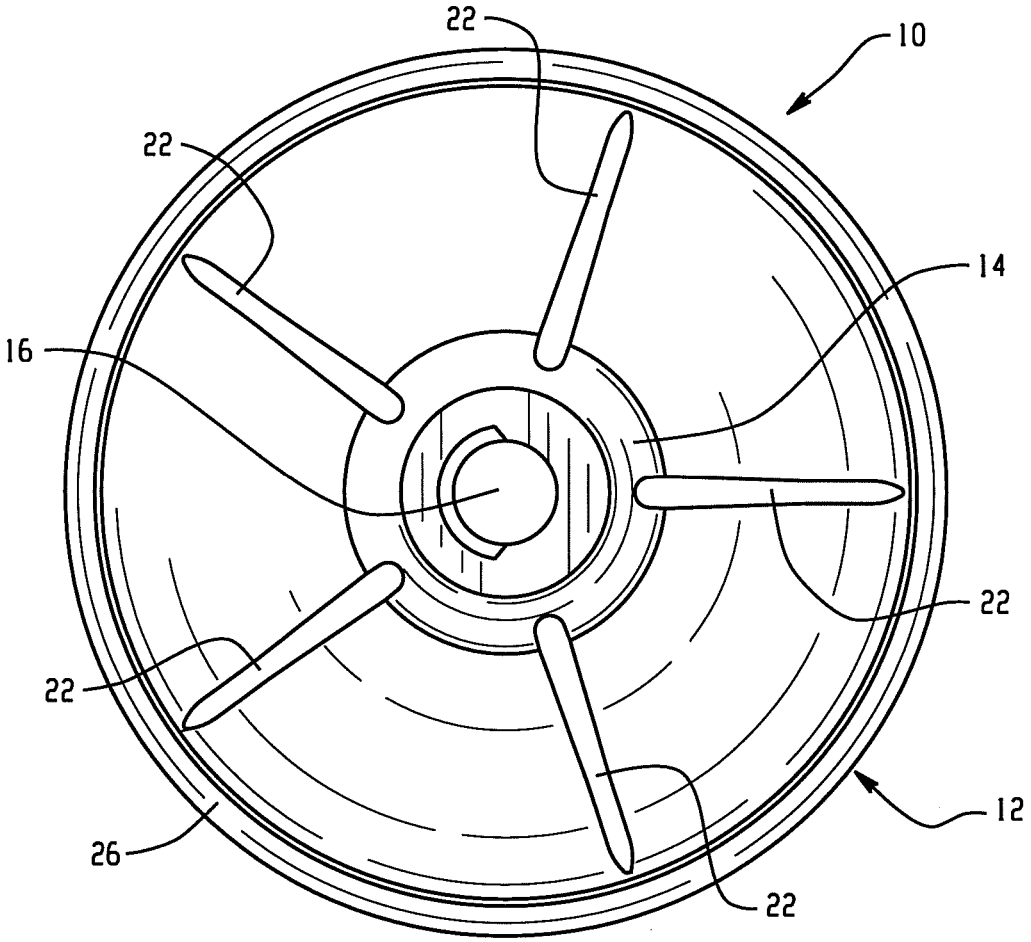
FIG. 2 is a top view of the exemplary plunger of FIG. 1.
Figure 3:
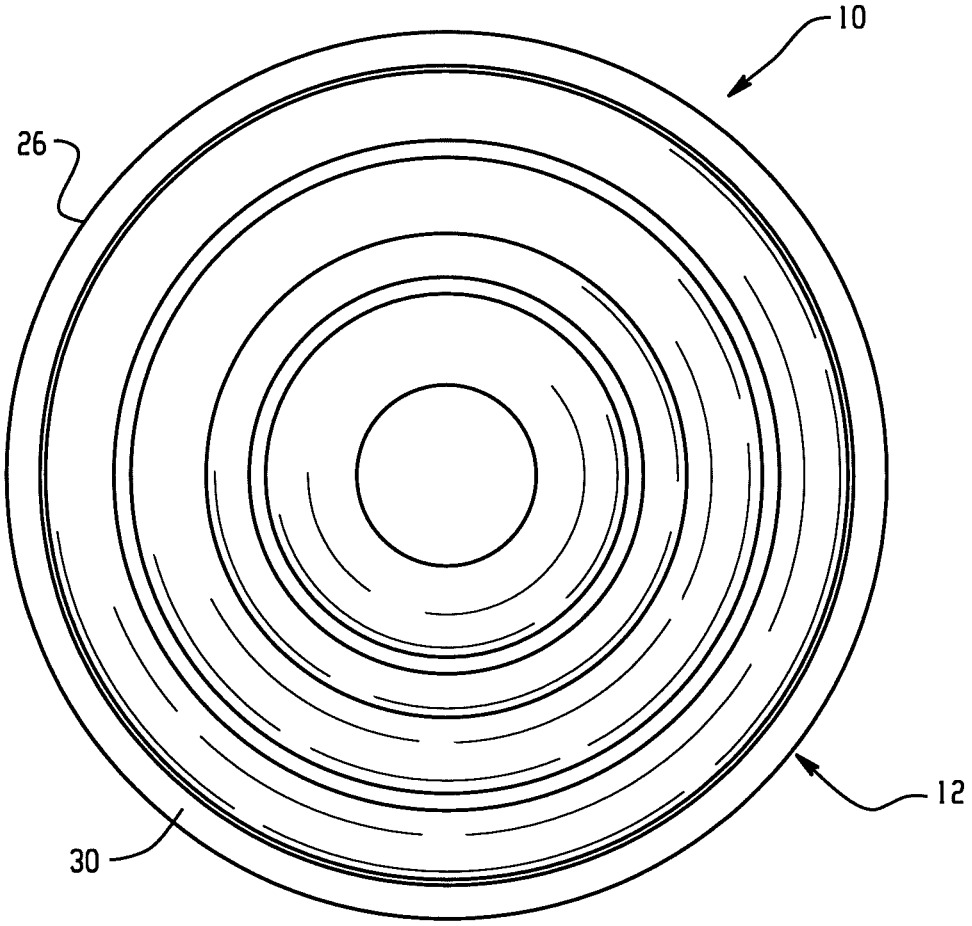
FIG. 3 is a bottom view of the exemplary plunger of FIG. 1.
Figure 4:
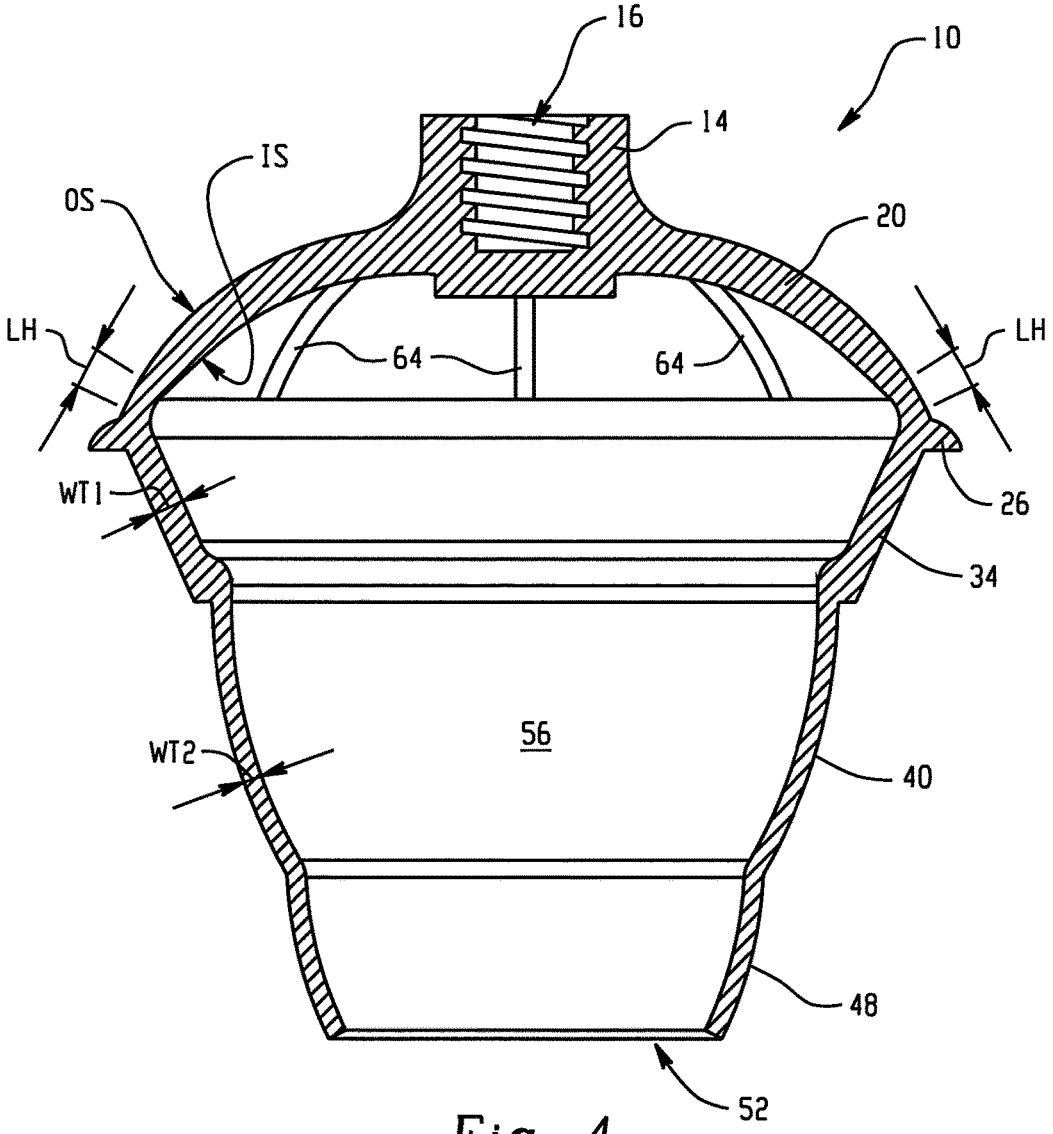
FIG. 4 is a cross-sectional view of the exemplary plunger taken along the line 4-4 in FIG. 1.

As seen in FIGS. 2 and 4, handle flange portion 14 includes a threaded bore 16 for connection to a plunger handle H. In this regard, a threaded wood, plastic, or other handle H is provided for threaded insertion into bore 16 in a conventional fashion. Other connection mechanisms can be provided without departing from the scope of the present disclosure. In some embodiments, the handle H can be formed integrally with the body 12 or otherwise formed in common process.

Body 12 further includes upper domed portion 20 having a plurality of reinforcing ribs 22 extending from near handle flange portion 14 to a lower edge of domed portion 20. A radially outwardly extending flange 26 extends from a circumferential periphery of the lower end of domed portion 20. Flange 26 has a curved upper surface 28 and a generally flat lower surface 30. Flange 26 provides circumferential reinforcement adjacent a living hinge LH region to further promote focused flexing of domed portion 20 at living hinge LH, as will be described.

Frustoconical portion 34, first bulbous portion 40 and second bulbous portion 48, respectively, extend downwardly from the domed portion 20. Each of frustoconical portion 34, first bulbous portion 40 and second bulbous portion 48 are of decreasing radius such that the upper portion of frustoconical portion 34 has a greatest radius while the terminal lower portion of the second bulbous portion 48 has a smallest radius. It should also be appreciated that second bulbous portion 48 defines, at a lower end thereof, an opening 52 into an interior chamber 56 of the body 12.

With reference to FIG. 4, it will be appreciated that the domed portion 20 and frustoconical portion 34 have a greater wall thickness than the first and second bulbous portions 40 and 48. For example, wall thickness WT1 is greater than WT2. As noted, the body 12 is generally a unitary, one-piece construction, and is typically made through a molding process. In the exemplary embodiment, the wall thickness is the thickness of the body between an outer surface OS and an inner surface IS of the body 12. It should further be appreciated that inner surface IS includes a plurality of ribs 64 for preventing inner surface IS from forming a vacuum seal with frustoconical portion 34 when the domed portion 20 is fully collapsed. That is, ribs 64 prevent the domed portion 20 from creating a vacuum seal with frustoconical portion 34 when fully collapsed that would prevent or make difficult restoring the domed portion 20 to its uncollapsed state. Ribs 64 can be similar to ribs 22, for example.

Figure 5:
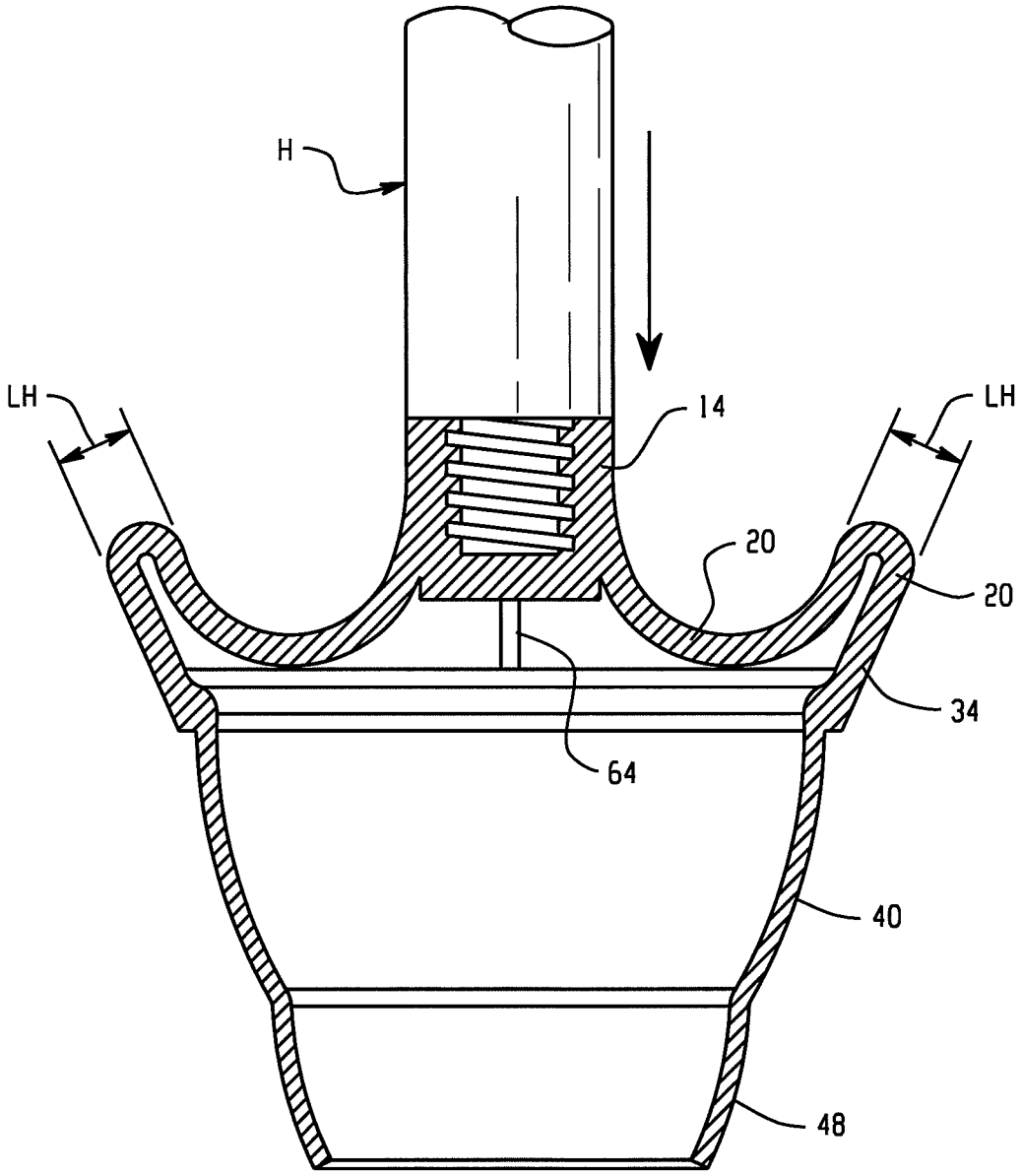
FIG. 5 is a similar view to FIG. 4, but with the plunger in a compressed state.

Turning to FIG. 5, during plunging operations the relative thicknesses of the different portions of the body 12, and their corresponding relative stiffnesses, produces an enhanced plunging effect that not only improves plunging operations on regular and low-flow toilets, but also provides a more stable plunging action which can reduce splashing and/or sloshing of water/sewage within the toilet boil.

In use, the plunger 10 is inserted into the throat of the toilet such that the first and second bulbous portions 40 and 48 are fully seated as far as practical into the throat and/or leading portion of the line drain. Because the first and second bulbous portions 40 and 48 are relatively more flexible than the remainder of the body 12, the bulbous portions more readily deform adjacent and/or within the throat to contact and seal against a perimeter thereof. This allows the plunger body 12 to easily form a suitable seal against the relevant surfaces of the toilet. The bulbous portions 40 and 48 can also readily deform to at least partially block any siphon jet opening within the throat to prevent pressure/suction generated by the plunger from bypassing the toilet throat/drain line containing the clog.

It should be appreciated that the first and second bulbous portions 40 and 48 are tapered such that a waistline 56, or narrowed section exists at the transition from the first bulbous portion 40 to the second bulbous portion 48. In use, as downward force is applied to the plunger 10 the waistline provides a naturally buckling zone that allows the lower second bulbous 48 portion to buckle relative to the upper first bulbous portion 40 while the upper bulbous portion 40 remains sealed against the surfaces of the bowl surround the throat and/or jet siphon (or other relevant surface). This buckling action allows the plunger 10 to be used on a wide variety of toilet designs by accommodating bowls and throats of various sizes and shapes, and indeed makes the plunger 10 suitable for use on other drain lines (e.g. sinks, utility drains etc). In addition, the buckling action can be utilized to angle the opening of the plunger to direct pressure/suction in a particular direction (e.g., down the throat towards the clog) if desired.

The ability of the first and second bulbous portions to deform and readily conform to the toilet surfaces facilitates use of the plunger in a wide variety of toilets having bowls/throats/drain opening of virtually any shape, including both conventional toilets as well as low-flow toilets. The frustoconical portion 34 of the body 12 is adapted to be closely received in the converging portion of the toilet bowl adjacent the throat and/or a portion of the throat itself. The frustoconical portion 34 is, therefore, generally supported circumferentially about a major portion of its circumference by the bowl when the plunger 10 is used. The relatively larger thickness of the frustoconical portion 34 helps the portion retain its shape during plunging operations, and generally provides a secure foundation for the domed portion 20 to be compressed against.

To this end, the domed portion 20 is configured to collapse downwardly when pressure is applied thereto via handle H. The domed portion 20 generally collapses from a circumferentially outer point near the flange 26. As best seen in FIGS. 4 and 5, the domed portion 20 includes a portion thereof with a reduced thickness adjacent flange 26 that acts as a living hinge LH (see FIG. 4). It should be appreciated, however, that the domed portion 20 remains fully supported by the frustoconical portion 34 during such compression/collapse such that the domed portion 20 collapses in a controlled manner into the frustoconical portion 34, which itself is generally supported circumferentially by the toilet as noted above.

The net effect of these features is that the domed portion 24 can be repeatedly compressed and decompressed to create pressure and/or suction, while the frustoconical portion 34 and/or first and second bulbous portions 40/48 remain in a relatively stable configuration to maintain sufficient sealing and support of the domed portion 24. Contrary to some prior art plunger designs wherein portions of the entire plunger collapse during compression, the plunger 10 in accordance with the present disclosure can accept a more rigorous and/or forceful plunging action with reduced splashing, since primarily only the domed portion 24 need be displaced during plunging. This allows a user to apply a more powerful, yet shorter, plunging stroke resulting in a more effective plunging action.

Testing of a plunger in accordance with the present disclosure has shown an increase in developed pressure as compared to plungers lacking the features set forth above. In addition, the observed increase in developed pressure is achieved with a shorter plunger stroke than prior art plungers specifically designed to work with low-flow toilets. The shorter plunger stroke results in less potential for splashing of water within the toilet bowl.

FIGS. 6-9 illustrate another exemplary embodiment of a plunger 10' in accordance with the present disclosure. The plunger 10' is identical to the plunger 10 of FIGS. 1-4 except that it does not include the frustoconical portion 34 of plunger 10. As such, plunger 10' comprises a one-piece body 12' that can be described as having a plurality of discrete portions. The body 12' can be made of an elastomeric material such as rubber, and formed in a molding process, for example.

With continued reference to FIGS. 6-9, each of the following portions of the body 12' will be described: handle flange portion 14', domed portion 20', perimeter flange 26', first bulbous portion 40, and second bulbous portion 48'.

Figure 6:
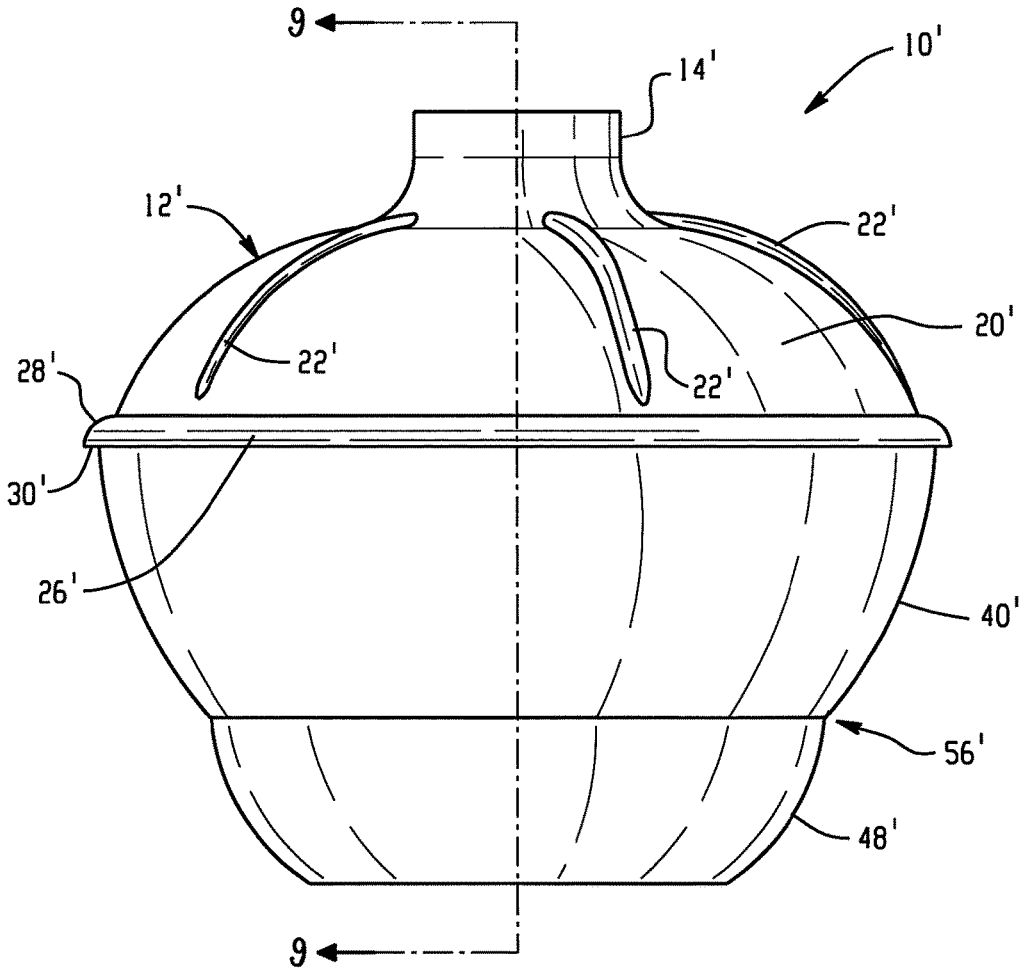
FIG. 6 is a side view of another exemplary plunger in accordance with the present disclosure.
Figure 7:
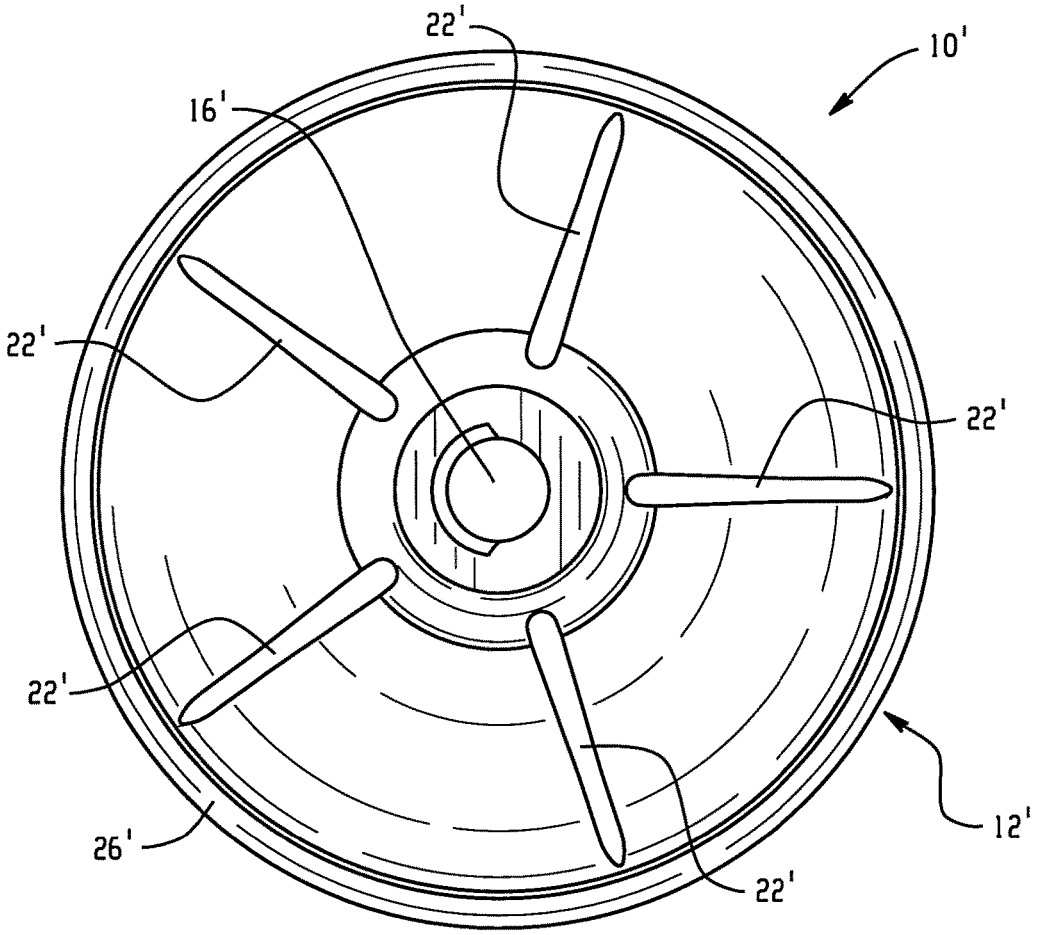
FIG. 7 is a top view of the exemplary plunger of FIG. 6.
Figure 8:
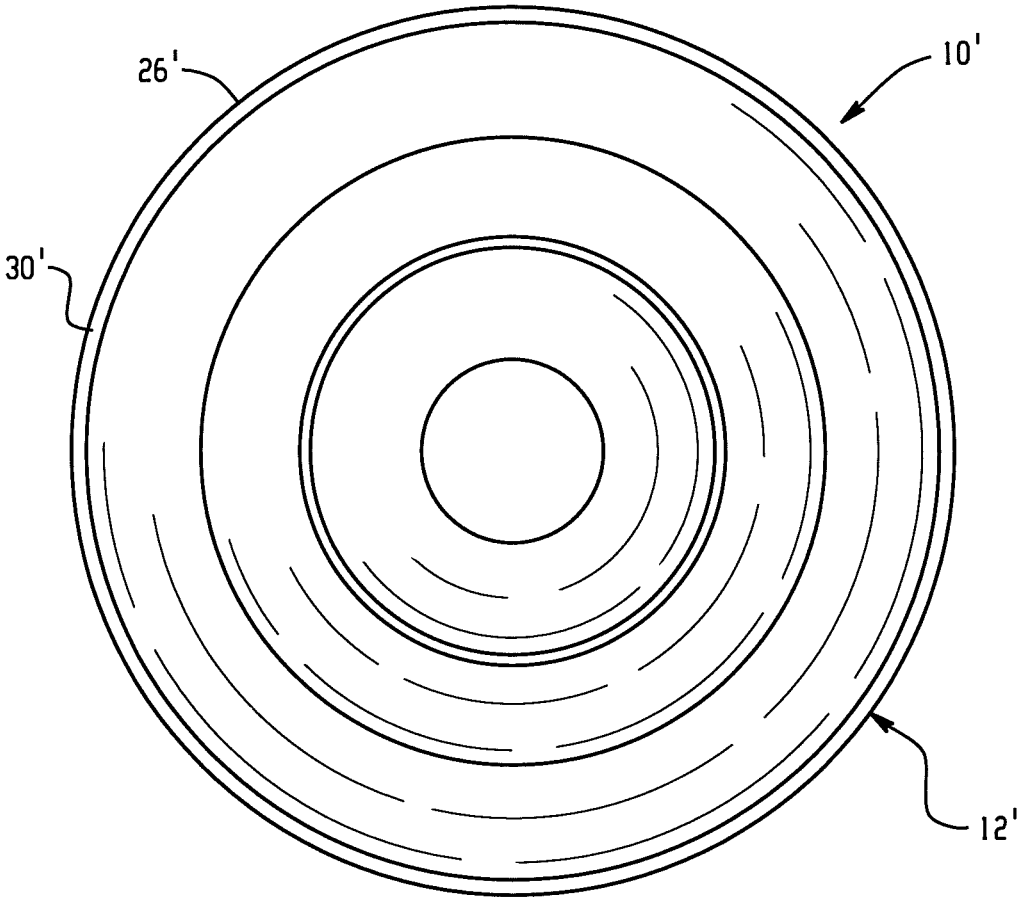
FIG. 8 is a bottom view of the exemplary plunger of FIG. 6.
Figure 9:
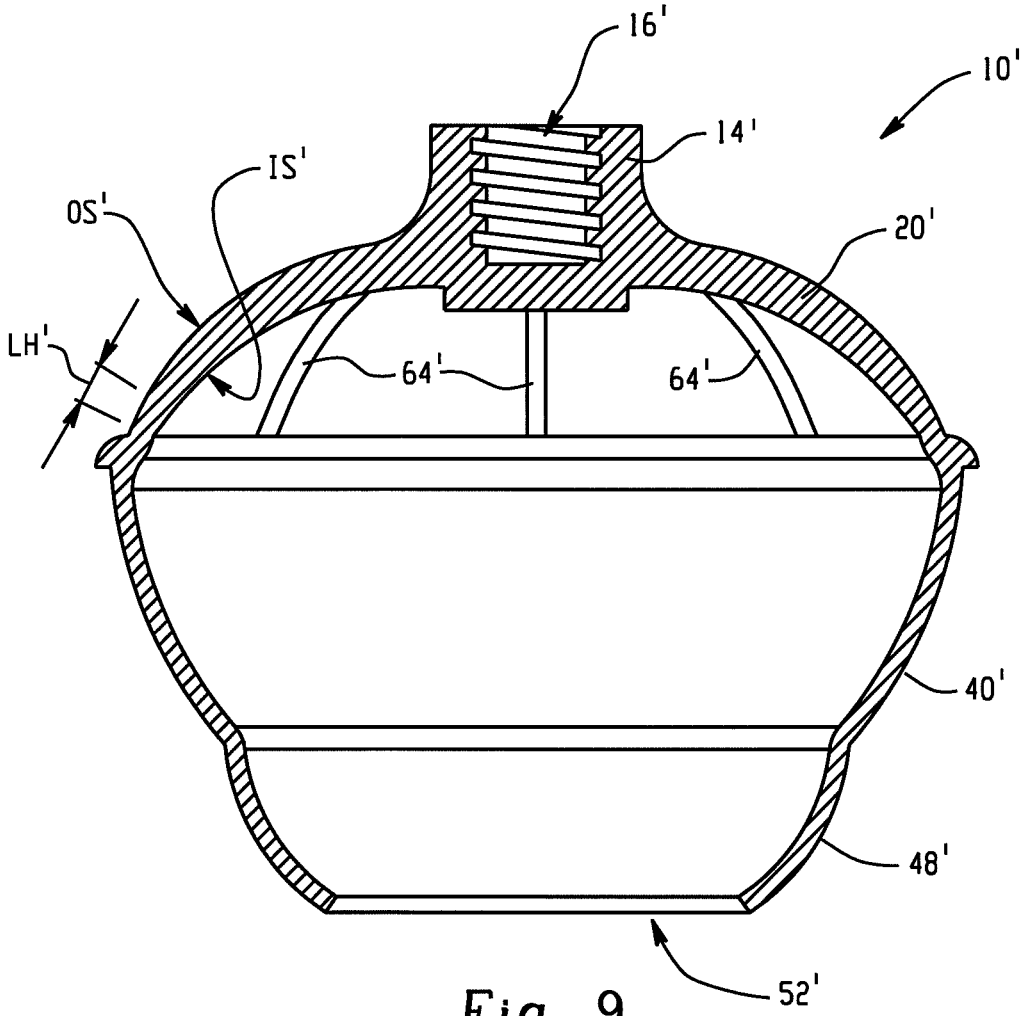
FIG. 9 is a cross-sectional view of the exemplary plunger taken along the line 9-9 in FIG. 6.

As seen in FIGS. 6 and 9, handle flange portion 14' includes a threaded bore 16' for connection to a plunger handle H'. In this regard, a threaded wood, plastic, or other handle H' is provided for threaded insertion into bore 16' in a conventional fashion. Other connection mechanisms can be provided without departing from the scope of the present disclosure. In some embodiments, the handle H' can be formed integrally with the body 12' or otherwise formed in a common process.

Body 12' further includes upper domed portion 20' having a plurality of reinforcing ribs 22' extending from near handle flange portion 14' to a lower edge of domed portion 20'. A radially outwardly extending flange 26' extends from a circumferential periphery of the lower end of domed portion 20'. Flange 26' has a curved upper surface 28' and a generally flat lower surface 30'. Flange 26' provides circumferential reinforcement adjacent a living hinge LH' region to further promote focused flexing of domed portion 20' at living hinge LH', as will be described.

First bulbous portion 40' and second bulbous portion 48' extend downwardly in succession from the domed portion 20'. First bulbous portion 40' and second bulbous portion 48' are of decreasing radius such that the upper portion of first bulbous portion 40' has a greatest radius adjacent the domed portion 20' while the terminal lower portion of the second bulbous portion 48' has a smallest radius. It should also be appreciated that second bulbous portion 48' defines, at a lower end thereof, an opening 52' into an interior chamber 56' of the body 12'.

Plunger 10' operates in a similar manner to the operation of plunger 10 described above. However, without frustoconical portion 34, the domed portion 20' is configured to collapse into the first bulbous portion 40'.

The exemplary embodiment has been described with reference to the preferred embodiments. Modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A plunger comprising:

a plunger body having a handle flange portion for connection to an associated handle, a domed portion extending from the handle flange portion, a frustoconical portion extending from the domed portion, and a first bulbous portion extending from the frustoconical portion, wherein the frustoconical portion has a wall thickness that is greater than a wall thickness of the first bulbous portion, and wherein a smallest diameter of the frustoconical portion is greater than a largest diameter of the first bulbous portion.

2. The plunger of claim 1, wherein the domed portion includes a wall having a reduced cross-section thickness portion adjacent the frustoconical portion, wherein the domed portion is configured to collapse about the reduced cross-section thickness portion into at least a portion of the frustoconical portion.

3. The plunger of claim 2, further comprising a second bulbous portion extending from the first bulbous portion.

4. The plunger of claim 3, wherein the first and second bulbous portions each have a wall thickness less than the domed portion and the frustoconical portion.

5. The plunger of claim 1, wherein the body is a unitary, one-piece elastomeric body.

6. The plunger of claim 1, wherein the domed portion has at least one rib on an inner surface thereof, the at least one rib configured to maintain a minimum amount of space between the domed portion and the frustoconical portion when the domed portion is collapsed into the frustoconical portion.

7. The plunger of claim 1, further comprising the handle.

8. The plunger of claim 3, wherein a smallest diameter of the first bulbous portion is greater than the largest diameter of the second bulbous portion.

9. The plunger of claim 8, wherein the first bulbous portion has a first axial length and the second bulbous portion has a second axial length, and wherein the first axial length is greater than the second axial length.

10. The plunger of claim 9, further comprising a waistline at the transition of the first bulbous portion to the second bulbous portion.

11. The plunger of claim 1, wherein the frustoconical portion includes an annular axial end face.

12. A method of unclogging a drain comprising:

positioning a plunger in an opening of the drain, the plunger having a plunger body having a handle flange portion for connection to an associated handle, a domed portion extending from the handle flange portion, a frustoconical portion extending from the domed portion, and a first bulbous portion extending from the frustoconical portion, wherein the frustoconical portion has a wall thickness that is greater than a wall thickness of the first bulbous portion, and wherein a smallest diameter of the frustoconical portion is greater than a largest diameter of the first bulbous portion, the plunger being positioned such that the opening in the body of the plunger is engaged with the drain;

applying a force along the central axis of the body sufficient to collapse the first wall section into the second wall section.

13. A plunger comprising:

a plunger body having a handle flange portion for connection to an associated handle, a domed portion extending from the handle flange portion, a frustoconical portion extending from the domed portion, and a first bulbous portion extending from the frustoconical portion, wherein the frustoconical portion has a wall thickness that is greater than a wall thickness of the first bulbous portion.

* * * * *